US005400441A

United States Patent [19]

Yoshida

[11] Patent Number: 5,400,441

[45] Date of Patent: Mar. 28, 1995

[54] DYED ZIPPER TAPES ON GARMENT

[75] Inventor: Hiroshi Yoshida, Toyama, Japan

[73] Assignee: Yoshida Kogyo K.K., Tokyo, Japan

[21] Appl. No.: 54,240

[22] Filed: Apr. 30, 1993

[30] Foreign Application Priority Data

Apr. 30, 1992 [JP] Japan ..... 4-028869

[51] Int. Cl.[6] ..... D06P 1/00; A41D 27/00; A41D 27/08

[52] U.S. Cl. ..... 2/243.1; 2/244; 2/69; 139/420 A; 24/405; 24/398; 8/478

[58] Field of Search ..... 2/69, 69.5, 75, 80, 2/93, 105, 106, 94, 114, DIG. 2, DIG. 6, DIG. 7, 243.1; 24/390, 397, 398, 405, 412, 415, 442, DIG. 11; 139/420 A; 66/196, 202; 8/483, 485, 478

[56] References Cited

U.S. PATENT DOCUMENTS

| | | | |
|---|---|---|---|
| 686,699 | 11/1901 | Bandler | 2/DIG. 2 X |
| 1,983,070 | 12/1934 | Cox | 24/405 |
| 3,234,564 | 2/1966 | Chujfi | 2/DIG. 2 X |
| 3,490,072 | 1/1970 | Keltner | 2/114 |
| 3,948,597 | 4/1976 | Sakaoka | 8/485 X |
| 4,251,582 | 2/1981 | Bernier et al. | 24/415 X |
| 4,686,714 | 8/1987 | Harley | 2/114 |
| 5,172,456 | 12/1992 | Samberg et al. | 24/397 |
| 5,204,995 | 4/1993 | Knapp | 2/DIG. 2 X |

FOREIGN PATENT DOCUMENTS

| | | |
|---|---|---|
| 0336347 | 10/1989 | European Pat. Off. . |
| 0458637 | 11/1991 | European Pat. Off. . |
| 2729088 | 1/1978 | Germany . |

*Primary Examiner*—Jeanette E. Chapman
*Attorney, Agent, or Firm*—Hill, Steadman & Simpson

[57] ABSTRACT

In a slide fastener to be attached to an opening such as of the front part of a garment, the front surface of the slide fastener tape is dyed in the same color and pattern as a front cloth of the garment 1 while the back surface of the tape is dyed in the same color and pattern as a lining cloth of the garment. If it is attached to the opening of the garment, the slide fastener does not stand out even when the front part of the garment is opened.

2 Claims, 3 Drawing Sheets

DYED ZIPPER TAPES ON GARMENT

BACKGROUND OF THE INVENTION

1. Field of the Invention

This invention relates to a garment with a slide fastener using a special tape and attached to an opening such as a front part of the garment.

2. Description of the Related Art

In the conventional type slide fastener to be attached to an opening such as a front part of a garment, a tape dyed in the same color on opposite sides as a front cloth of the garment is used.

In the above-mentioned conventional garment, since the slide fastener to be attached to the front opening of the garment is dyed in the same color on opposite sides as the front cloth of the garment, the back side of the slide fastener tape having a different color from that of a back or lining cloth of the garment can be seen from the neck portion of the garment to show horribly, particularly if the garment is a jumper and the slide fastener is closed only halfway to leave the neck portion open or is completely opened. Therefore, the slide fastener must be sewn to the garment so as to conceal the slide fastener tape with the lining cloth so that the tape different in color from the lining cloth will not stand out, thus causing delicate tailoring.

SUMMARY OF THE INVENTION

With the foregoing problems in view, it is an object of this invention to provide a garment with a slide fastener which is attached to an opening such as a front part of the garment and whose tape is dyed in different colors on opposite sides, for example, the front surface of the tape in the same color and pattern as the front cloth, and the back surface in the same color and pattern as the lining cloth.

The above object of the invention can be accomplished by a garment having different colors and patterns on opposite sides, wherein a slide fastener including a pair of,tapes are attached to an opening of the garment, each tape having a front surface dyed in the same color and pattern as a front cloth of garment, and a back surface dyed in the same color and pattern as a lining cloth of the garment.

Preferably first threads dyeable by a first dye may be much more exposed on the front surface of the tape than the back surface, and second threads not dyeable by the first dye and dyeable by a second dye may be much more exposed on the back surface of the tape than the front surface.

Further, the slide fastener tape may have a double-sided structure including a front cloth on the front surface and a lining cloth on the back surface, the front cloth being woven of first threads dyeable by a first dye, and the lining cloth being woven of second threads dyeable by a second dye.

With this arrangement, since the front surface of the slide fastener tape is dyed in the same color and pattern as the front cloth of the garment and the back surface of the tape is dyed in the same color and pattern as the lining cloth, the slide fastener can be sewn to the edge of the opening on the front part of the garment anywhere so that it is unnecessary to cover the tape with the lining cloth of the garment.

DETAILED DESCRIPTION

Embodiments of this invention will now be described with reference to the accompanying drawings.

Figure 1:
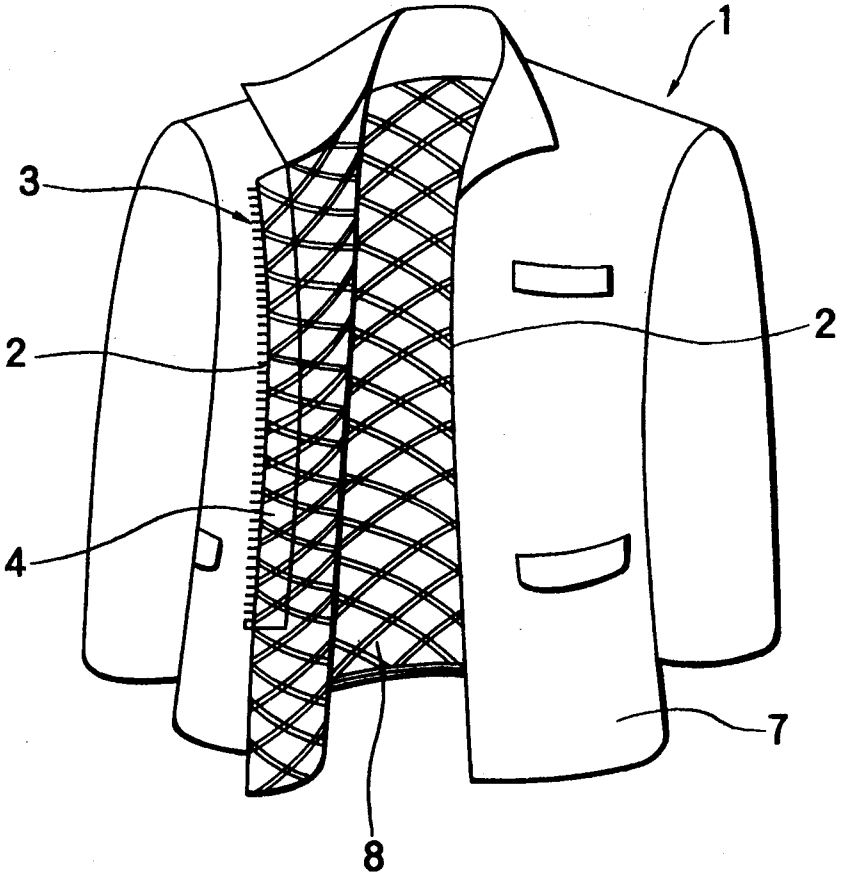
FIG. 1 is a perspective view of a garment.
Figure 2:
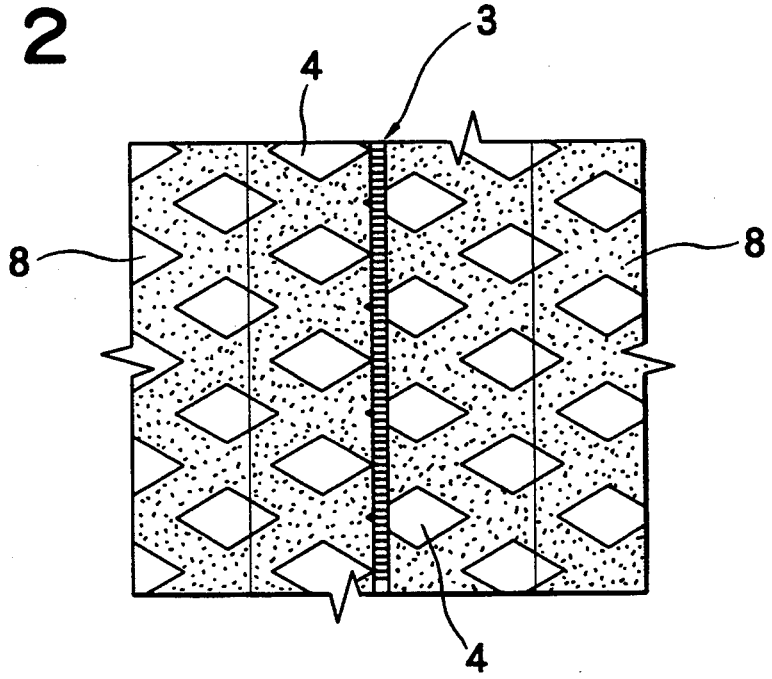
FIG. 2 is a rear view showing a front opening of the garment.
Figure 3:
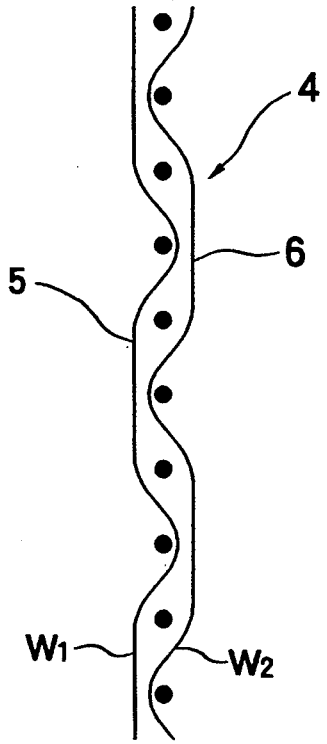
FIG. 3 is a diagrammatic cross-sectional view showing how warp threads of a slide fastener tape extend.
Figure 4:
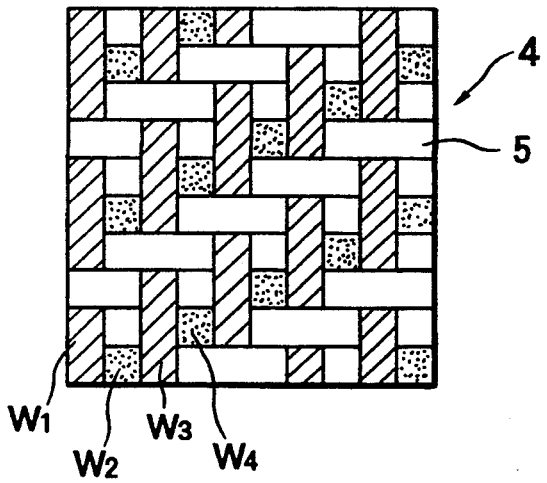
FIG. 4 is a diagram showing the structure of the tape of FIG. 3.

As shown in FIGS. 1 and 2, a slide fastener 3 attached to an opening 2, such as of the front part a garment 1, includes a pair of tapes 4 whose front surface 5 is dyed in the same color and pattern as a front cloth 7 of the garment 1 and whose back surface 6 is dyed in the same color and pattern as a lining cloth 8 of the garment 1. The structure of the slide fastener tape 4, as shown in FIGS. 3 and 4, is a twill in which warp threads $W_1$ and $W_3$ are much more exposed on the front surface 5 than the back surface 6 and comprise polyester while warp threads $W_2$ and $W_4$ are much more exposed on the back surface 6 than the front surface 5 and comprise rayon. Thus, the threads $W_1$, $W_3$ much more exposed on the front surface are difference in substance from the threads $W_2$, $W_4$ on the back surface 6 so that both sides of the tape 4 cannot be dyed by one and the same dye.

Figure 5:
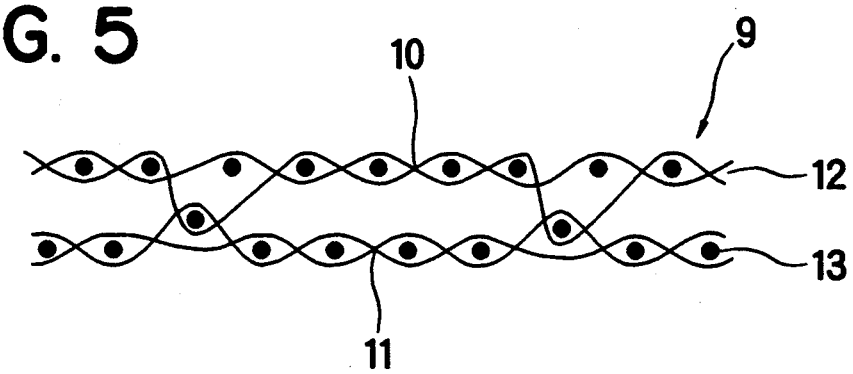
FIG. 5 is a diagrammatic cross-sectional view showing how warp threads of a modified slide fastener tape extend.

Alternatively, as shown in FIG. 5, a tape 9 of the slide fastener 3 has a double-woven structure in which threads of a cloth 12 of a front surface 10 of the tape 9 are different in substance from those of a cloth 13 of a back surface 11 of the tape 9, for example, the front cloth 12 comprise polyester threads while a lining cloth 13 comprise rayon threads, so that both sides of the tape a cannot be dyed by one and the same dye.

For dyeing, the front surface 5, 10 of the tape 4, 9 is previously dyed in the same color as a cloth to be used in the garment, and then the back surface 6, 11 of the tape 4, 9 is dyed in the same color as the lining cloth 8 of the garment 1 by, for example, ink jet dyeing or spray dyeing.

When the slide fastener 3 using the thus dyed tape 4, 9 is to be attached to the garment 1, the tape 4, 9 is sewn to the garment 1 without being covered by the lining cloth 8 of the garment 1. Alternatively, the tape 4, 9 may be sewn directly to the front surface of the lining cloth 8.

The woven structure of the tape, dyeing method and sewing method,should by no means be limited to the foregoing illustrated example.

The garment thus constructed according to this invention has the following results.

With the garment of this invention, since the front surface of the slide fastener tape is dyed in the same color and pattern as the front cloth of the garment while the back surface of the tape is dyed in the same color and pattern as the lining cloth, the tape having the same color as that of the lining cloth of the garment can be seen from the neck portion of the garment so that it does not appear remarkable when the slide fastener is closed only halfway to leave the neck portion open or is completely opened.

Further, since any part of the slide fastener tape can be sewn to the garment without being covered with the lining cloth, easy tailoring can be achieved.

Furthermore, partly since the first threads dyeable with the first dye are much more exposed on the front surface of the tape than the back surface and since the second threads which are not dyeable with the first dye but the second dye are much more exposed on the back surface than the front surface, and partly since the tape has a double-woven structure whose front cloth is woven of the first threads dyeable by the first dye and the second threads dyeable by the second dye, it is possible to dye the front and back surfaces of the slide fastener tape in different colors and patterns. For example, since the front tape surface may be dyed previously in the same color as the front cloth of the garment and then the back tape surface may be dyed until after receiving an order, it is possible to manufacture the slide fasteners meeting the demand for products.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A garment having different colors and patterns on opposite sides, wherein a slide fastener including a pair of tapes are attached to an opening of said garment, each of said tapes having a front surface dyed in the same color and pattern as a front cloth of said garment, and a back surface dyed in the same color and pattern as a lining cloth of said garment wherein first threads dyeable by a first dye are much more exposed on said front surface of said tape than said back surface, and second threads not dyeable by said first dye are much more exposed on said back surface of said tape than said front surface.

2. The garment according to claim 1, wherein said tape has a double-sided structure including a front cloth on said front surface and a lining cloth on said back surface, said front cloth being woven of first threads dyeable by a first dye, and said lining cloth being woven of second threads dyeable by a second dye.

* * * * *